US007673413B2

(12) United States Patent
Bentley

(10) Patent No.: US 7,673,413 B2
(45) Date of Patent: Mar. 9, 2010

(54) FIREARM STOCK CONVERSION METHOD

(75) Inventor: James K. Bentley, Paso Robles, CA (US)

(73) Assignee: Blackhawk Industries Product Group Unlimited LLC, Norfolk, VA (US)

( * ) Notice: Subject to any disclaimer, the term of this patent is extended or adjusted under 35 U.S.C. 154(b) by 472 days.

(21) Appl. No.: 11/796,592

(22) Filed: Apr. 28, 2007

(65) Prior Publication Data

US 2009/0300962 A1 Dec. 10, 2009

(51) Int. Cl.
*F41A 11/04* (2006.01)

(52) U.S. Cl. ..... 42/75.03; 42/75.1; 42/72

(58) Field of Classification Search ..... 42/75.03, 42/75.1, 75.01, 72
See application file for complete search history.

(56) References Cited

U.S. PATENT DOCUMENTS 3,380,182 A * 4/1968 Browning ..... 42/75.03

5,173,564 A * 12/1992 Hammond, Jr. ..... 42/75.03

* cited by examiner

*Primary Examiner*—Stephen M Johnson
(74) *Attorney, Agent, or Firm*—Bowman Green Hampton & Kelly, PLLC

(57) ABSTRACT

A method for upgrading a non-recoil suppressing (NRS) stock to a special operations (Spec Ops) stock with full recoil suppression. The new parts are the slide member and lever that has a cam member mounted on its upper end and an extension spring attached to its bottom end. A locking pin is removed from the stationary slide member and two retainer pins are inserted from the sides into the new slide member to facilitate spring action. This structure functions in the same manner as the recoil reduction structure illustrated in U.S. Pat. No. 5,722,195. A replacement sleeve has a rib member extending downwardly from its bottom surface. Replacement sleeve and extension spring are assembled in a tubular member to form a second recoil reduction assembly. This recoil reduction structure functions in the same manner as the structure illustrated in U.S. Pat. No. 6,732,466.

3 Claims, 8 Drawing Sheets

FIREARM STOCK CONVERSION METHOD

FIELD OF THE INVENTION

The invention relates to firearms and more specifically to a stock conversion method for a firearm having a non-recoil suppressing (NRS) stock. The stock conversion method will convert the non-recoil suppressing (NRS) stock to a special operations (Spec Ops) stock with full recoil suppression.

BACKGROUND OF THE INVENTION

One of the age-old problems that have existed with firearms is the fact that many of them have severe recoil that affects the person firing the weapon. In firearms such as shotguns and rifles, the rear end of the butt stock is positioned against the shooter's shoulder and the recoil often causes the shooter to raise the front of the firearm each time the weapon is fired. The amount of recoil varies depending upon the amount of explosive being fired and the recoil can result in pain or bruising to the shoulder area. One example of the recoil being detrimental to a shooter's accuracy is when the firearm is a shotgun being used for skeet shooting by a man or a woman.

In the past, the best prior art recoil systems for the butt stock of a firearm have been very expensive and the inexpensive systems did not function properly. Two examples of expensive systems are a hydro-coil fluid dampening system and a pneumatic air chamber system. The present day inexpensive recoil systems utilize compression coil springs to absorb the recoil forces. If the compression coil spring is a little too strong, you get more recoil than with a regular firearm. If the compression coil spring is not strong enough it is worse, in that it gives the gun some travel and it is the same as holding the butt stock too loosely.

One of the improvements in recoil systems for a firearm is illustrated in the Bentley et al U.S. Pat. No. 5,722,195. It has a pistol grip recoil assembly having a recoil base member and a pistol grip. The recoil base member is detachably secured to the rear end of the receiver of the firearm and it has an inverted T-shaped rail formed on its bottom wall. This inverted T-shaped rail is captured within and slides in an inverted T-shaped groove in the top end of the pistol grip. A recess formed in the front wall of the pistol grip adjacent its top end allows the trigger guard of the firearm to travel rearwardly with respect to the pistol grip when the firearm is fired. Various embodiments utilize springs to return the recoil base member forwardly to its static position after dissipating the recoil of the firearm resulting from its being fired.

Another recent improved recoil system for a firearm is illustrated in the Bentley et al U.S. Pat. No. 5,752,339. This patent discloses a recoil system for the butt stock of a firearm having a recoil suppressor assembly whose front end is mounted in the cavity in the rear end of the gunstock. The piston ram of the recoil suppressor assembly in its static position extends rearwardly into a borehole cavity of an elongated recoil housing. When the firearm is shot, the elongated body portion of the recoil suppressor assembly and it's transversely extending mounting flange portion instantaneously travel rearwardly into the bore cavity with the bore hole of the body housing reciprocally traveling over the piston ram. A coil spring whose front end is secured to the front end of the body portion and whose rear end is secured to a cam assembly returns the elongated body portion to a static position once the recoil of the firearm has been suppressed.

It is an object of the Bentley patented inventions to provide a novel recoil system for a firearm that minimizes the amount of recoil force experienced by the person firing the weapon. It is also an object of the Bentley patented inventions to provide a recoil system for the butt stock of a firearm that minimizes pain to the shoulder to the person firing the weapon due to the recoil forces and muzzle rise. The inventions disclosed and claimed by the aforementioned Bentley patents have been designed for manufactured items and not intended to function in the manner described by the special operations stock with full recoil suppression upgrade.

In this respect, before explaining at least one embodiment of the stock conversion method in detail it is to be understood that the process is not limited in its application to the details of construction and to the arrangement of the components set forth in the following description or illustrated in the drawings. The upgrading process is capable of other embodiments and of being practiced and carried out in various ways. Also, it is to be understood that the phraseology and terminology employed herein are for the purpose of description and should not be regarded as limiting. The upgrading process accomplished by the manufacturer using a conversion method to convert the non-recoil suppressing (NRS) stock to a special operations (Spec Ops) stock with full recoil suppression, will be disclosed.

SUMMARY OF THE INVENTION

The principal advantage is that it involves the method how to create a special operations stock from a non-recoil suppressing stock.

Another advantage is that the stock conversion method reduces the cost of purchasing a new stock with the full recoil suppression incorporated.

And still another advantage is that an individual can purchase an entry-level stock and have the opportunity to have it upgraded to a special operations (Spec Ops) stock with full recoil suppression by the factory.

A final advantage of this invention is to add a new and unique stock conversion method to the area of firearms.

A new and unique method for upgrading a non-recoil suppressing (NRS) stock to a special operations (Spec Ops) stock with full recoil suppression describes a unique conversion method with parts that can be installed by the factory. The new parts are the slide member and lever that has a cam member mounted on its upper end and an extension spring attached to its bottom end. The recoil reduction structure is associated with the handgrip portion. A locking pin is removed from the stationary slide member and two retainer pins are inserted from the sides into the new slide member to facilitate spring action. This structure functions in the same manner as the recoil reduction structure illustrated in U.S. Pat. No. 5,722,195. A replacement sleeve has a rib member extending downwardly from its bottom surface. Replacement sleeve and extension spring are assembled in a tubular member to form a second recoil reduction assembly. The original handgrip portion and tubular member were integrally formed of plastic material. The original sleeve is also made of a plastic material, as is the stationary slide member. When the sleeve member is removed during the conversion process, a sleeve member is substituted therefore. This recoil reduction structure functions in the same manner as the structure illustrated in U.S. Pat. No. 6,732,466.

These together with other objects of the upgrading process, along with the various features of novelty, which characterize the stock conversion method, are pointed out with particularity in the claims annexed to and forming a part of this disclosure. For a better understanding of the process, its operating advantages and the specific objects attained by its uses, reference should be made to the accompanying drawings and descriptive matter in which there are illustrated preferred embodiments of the upgrading process. There has thus been outlined, rather broadly, the more important features of the stock conversion method in order that the detailed description thereof that follows may be better understood, and in order that the present contribution to the art may be better appreciated. There are additional features of the process that will be described hereinafter and which will form the subject matter of the claims appended hereto.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present disclosure. Therefore, the foregoing is considered as illustrative only of the principles of the stock conversion method. Further, since numerous modifications and changes will readily occur to those skilled in the art, it is not desired to limit the design to the exact construction and operation shown and described, and accordingly, all suitable modifications and equivalents may be resorted to, falling within the scope of the stock conversion method.

BRIEF DESCRIPTION OF THE DRAWINGS

The accompanying drawings, which are incorporated in and form a part of this specification, illustrate embodiments of the invention and together with the description, serve to explain the principles of this invention.

DETAILED DESCRIPTION OF THE PREFERRED EMBODIMENTS

As required, detailed embodiments of the stock conversion method are disclosed herein, however, it is to be understood that the disclosed embodiments are merely exemplary of the upgrading elements that may be embodied in various forms. Therefore, specific functional and structural details disclosed herein are not to be interpreted as limiting, but merely as basic for the claims and as a representative basis for teaching one skilled in the art to variously employ the present upgrading elements in virtually any appropriately detailed structure.

The Non-Recoil Suppressing (NRS) Stock 8 and method for upgrading to a Special Operations (Spec Ops) Stock 10 with Full Recoil Suppression will now be described by referring to the following FIGS. 1 through 10.

Figure 1:
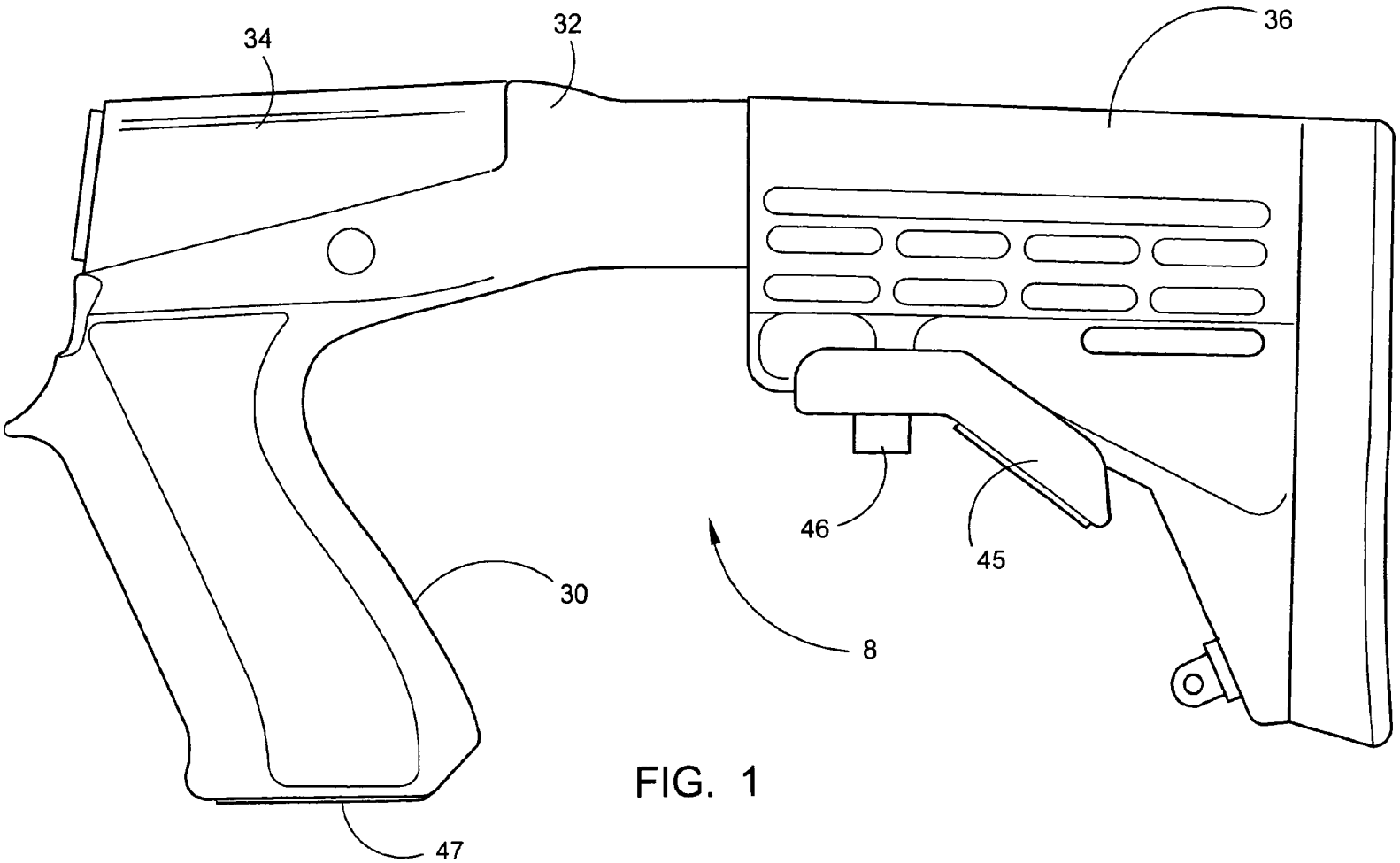
FIG. 1 depicts a side elevation of the Non-Recoil Suppressing (NRS) Stock.

FIG. 1 shows the assembled basic unit that is identified as the Non-Recoil Suppressing Stock 8. It has a handgrip portion 30 having an elongated tubular member extending from its rear end. A cover or stationary slide member 34 is rigidly connected to the top of handgrip portion 30. An adjustable length butt stock assembly 36 telescopically receives the rear end of tubular member 32. The adjustable length butt stock assembly 36 functions in the same manner as the butt stock assembly 140 functions in U.S. Pat. No. 6,732,466.

Figure 2:
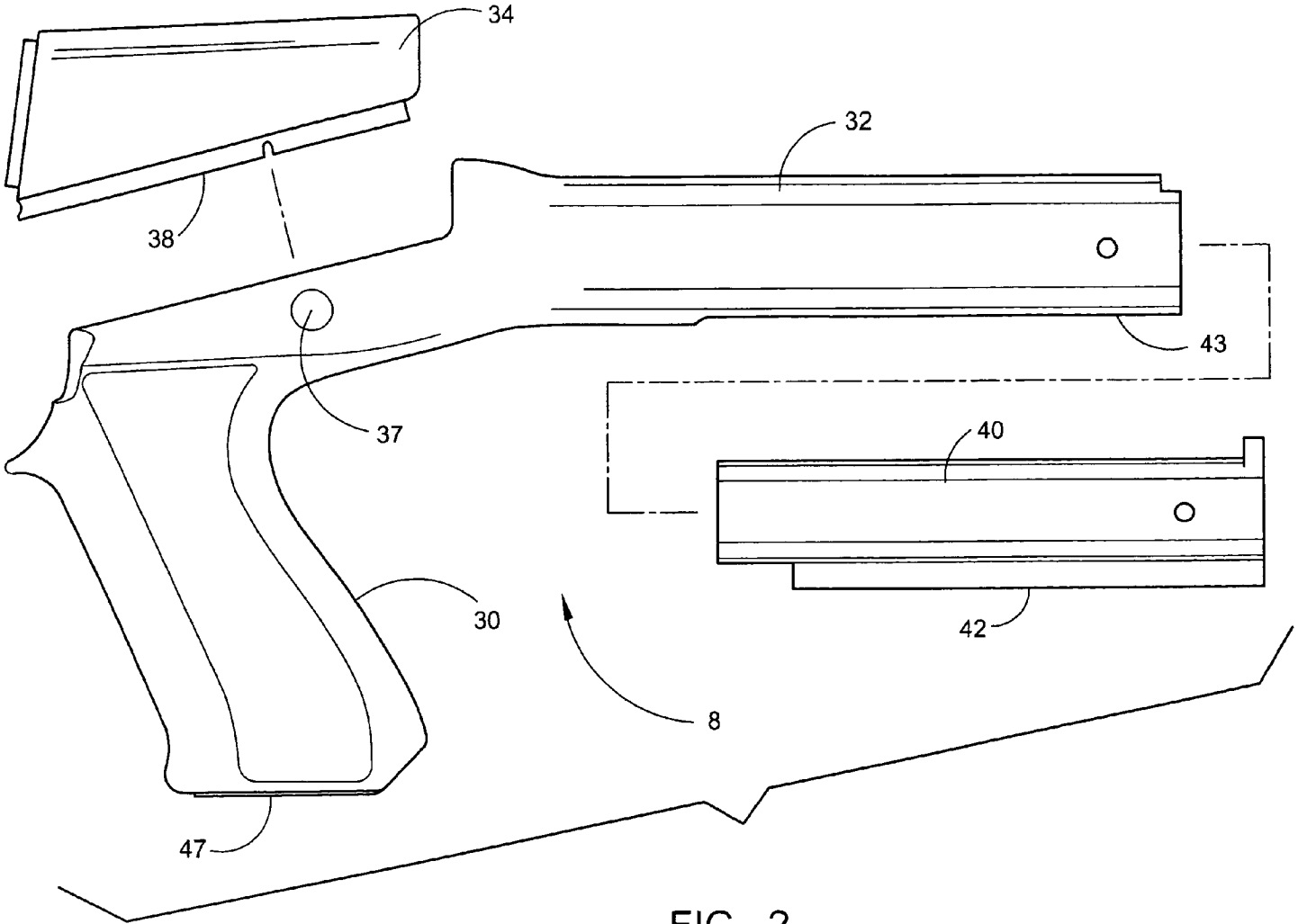
FIG. 2 depicts an exploded side elevation of the Non-Recoil Suppressing (NRS) Stock.
Figure 3:
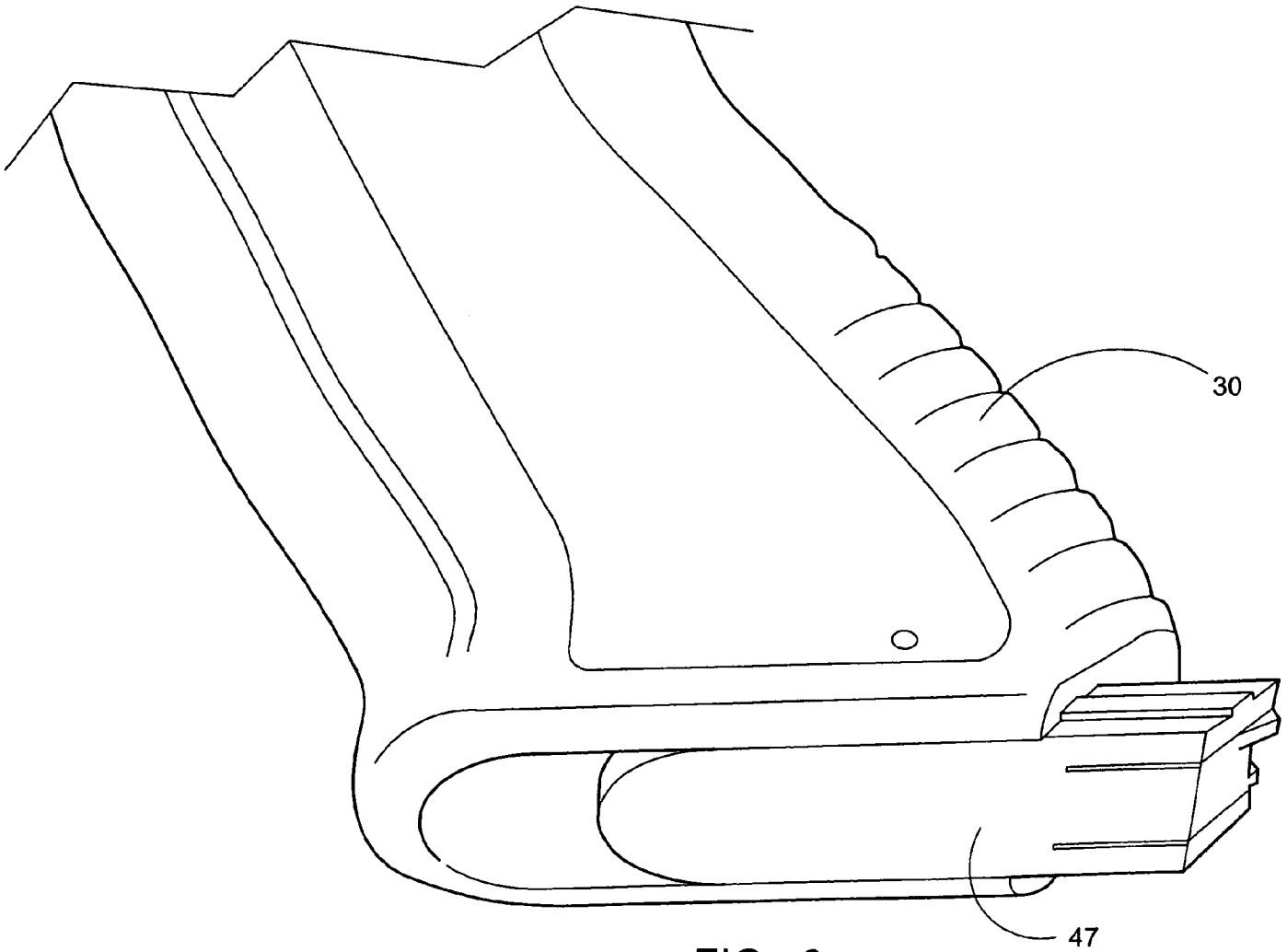
FIG. 3 depicts a perspective view of the bottom of the handgrip illustrating the sliding cover plate.

FIG. 2 depicts an exploded view showing the different parts of the Non-Recoil Suppressing Stock 8. Stationary slide member 34 is slid into the top end of handgrip portion 30 and a pin is driven through aperture 37 and locking slot 38 on the bottom surface of stationary slide member 34 to prevent any longitudinal travel. Tubular sleeve 40 is hollow and it is telescopically received in the rear end of tubular member 32. A rib member 42 extends downwardly from the bottom surface of tubular sleeve 40 and it mates with tubular member slot 43 formed in the bottom surface of tubular member 32. Adjustable length butt stock assembly 36 shown in FIG. 1 has a spring-loaded adjustment lever assembly 45 that retracts its head member 46 from the longitudinally spaced recesses in the bottom surface of rib member 42. This allows the adjustable length butt stock to be adjusted for different size shooters. Handgrip portion 30 is substantially hollow and it has a bottom cover plate 47 that is removable (as seen in FIG. 3 below). All of the structure just described constitutes the entire structure of the NRS Non-Recoil Reducing Stock 8.

Referring now to FIG. 3, there is shown an enlarged view of the handgrip portion 30. At the lower end of handgrip portion 30 there is a bottom cover plate 47 that slides out and off the handgrip portion 30 when removal is required, then slides back on again to re-assemble the handgrip portion 30 with bottom cover plate 47 in place.

Method for Stock Conversion

The method for up-grading the Non-Recoil Suppressing Stock 8 begins by removing tubular sleeve 40 and stationary slide member 34 from adjustable butt stock assembly 36. At this stage, what remain are the handgrip portion 30 and the disassembled adjustable butt stock assembly 36.

Figure 4:
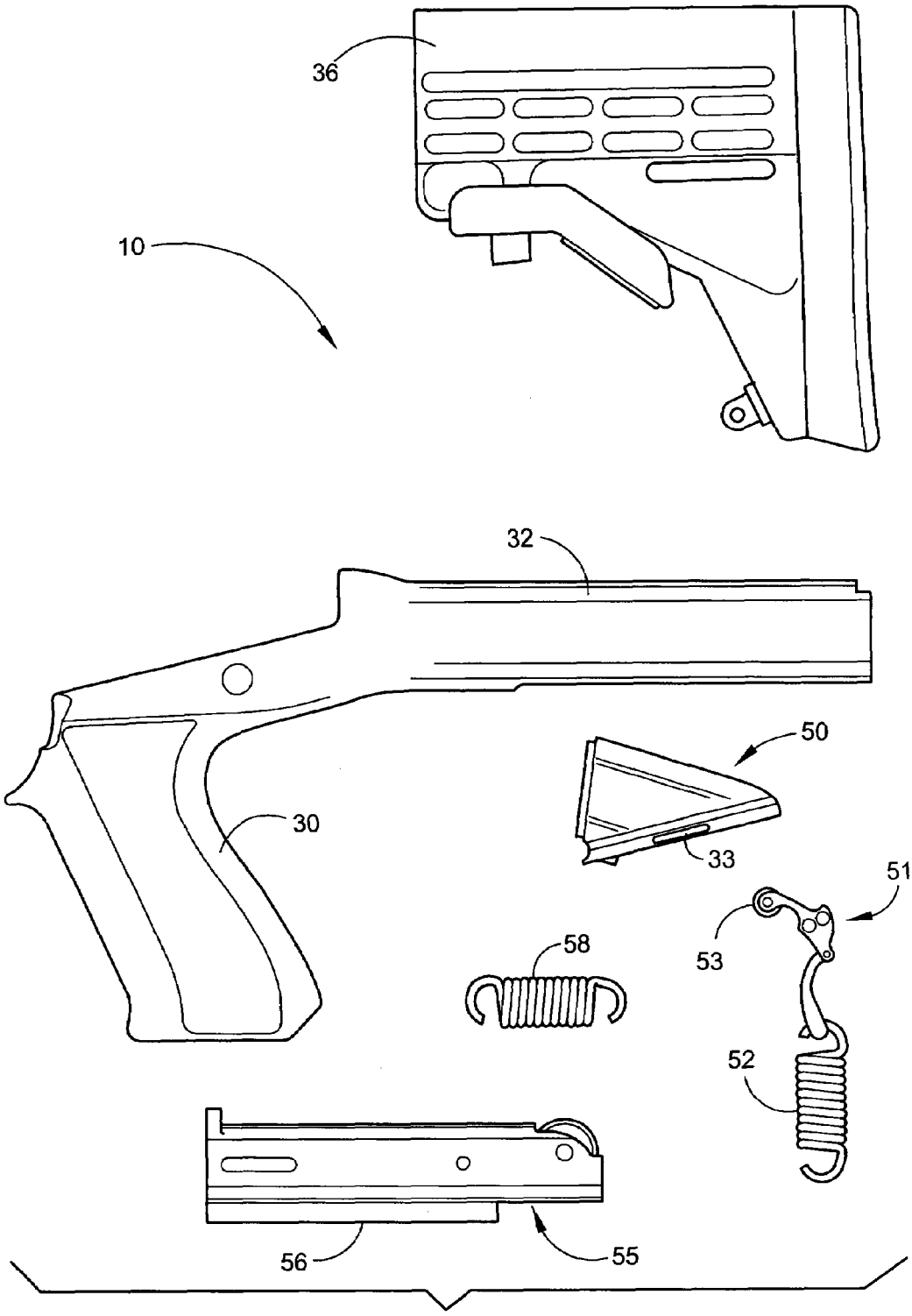
FIG. 4 depicts the new parts of the stock conversion that are assembled for the Special Operations (Spec Ops) Stock with Full Recoil Suppression.

FIG. 4 shows the new parts of the stock conversion for the Special Operations Stock 10 that are assembled to handgrip member 30 and within tubular member 32. These new parts are the slide member 50 and lever assembly 51 that has a cam member 53 mounted on its upper end and a lever assembly extension spring 52 attached to its bottom end. This recoil reduction structure is associated with handgrip portion 30. A locking pin is removed from the stationary slide member 34 and two retainer pins are inserted on each side of the tubular member 32 from the sides into retainer slots 33 in the new slide member 50 to facilitate spring action. This structure functions in the same manner as the recoil reduction structure illustrated in U.S. Pat. No. 5,722,195. A replacement sleeve 55, also shown in FIG. 5, has a rib member 56 extending downwardly from its bottom surface. Replacement sleeve 55 and extension spring 58 are assembled in tubular member 32 to form a second recoil reduction assembly. The handgrip portion 30 and tubular member 32 are integrally formed of plastic material. The original sleeve 40 is also made of a plastic material, as is stationary slide member 34. When sleeve member 40 is removed during the conversion process, sleeve member 55 is substituted therefore. This recoil reduction structure functions in the same manner as the structure illustrated in U.S. Pat. No. 6,732,466.

Figure 5:
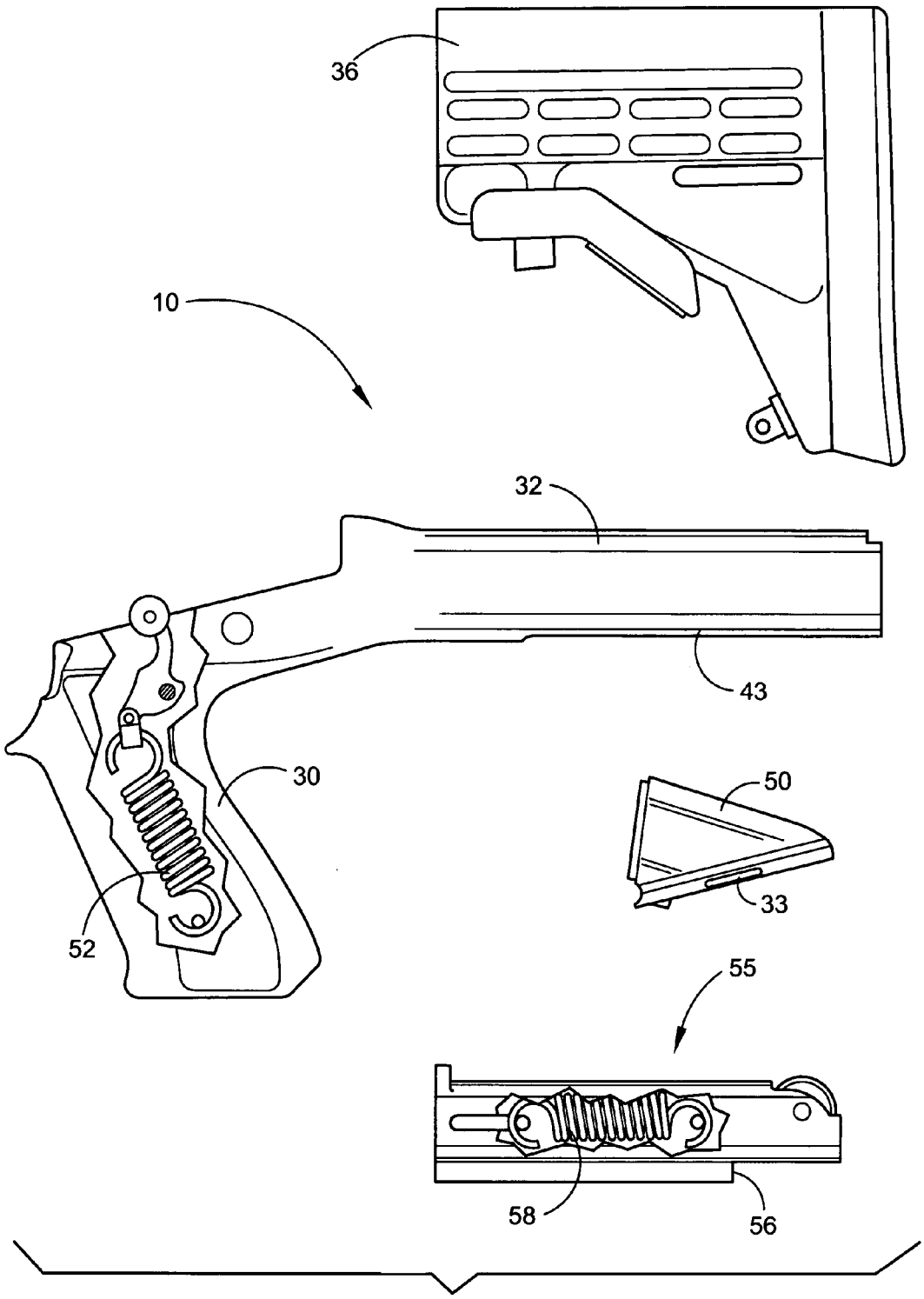
FIG. 5 depicts the initial steps in installing the parts of the stock conversion for the Special Operations (Spec Ops) Stock with Full Recoil Suppression.
Figure 6:
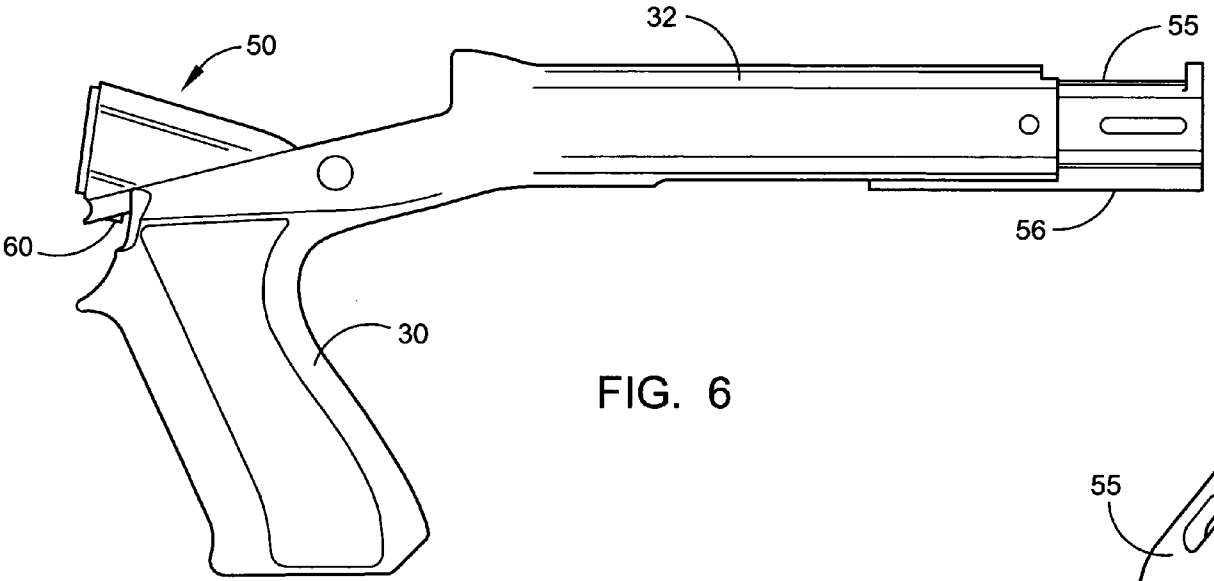
FIG. 6 depicts the replacement sleeve member being inserted into the rear end of the tubular member on the handgrip portion.

FIG. 5 shows the initial steps in installing the second recoil reduction structure within the Special Operations Stock 10. Lever 51 and extension spring 52 are inserted into the bottom end of handgrip member 30 after its cover has been removed. Replacement sleeve extension spring 58 is inserted into the replacement sleeve member 55 shown in position by a cutaway view. FIG. 6 shows the replacement sleeve member 55 being inserted into the rear end of tubular member 32. It also shows that slide member 50 that has been slid into the tracks formed in the top end of handgrip portion 30.

Figure 8:
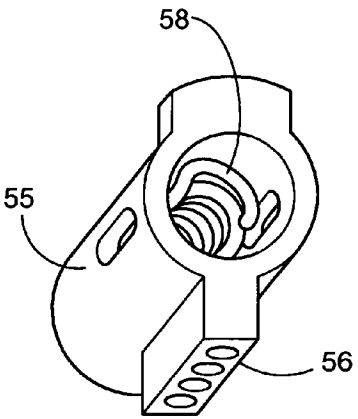
FIG. 8 depicts the rear end of replacement sleeve with the extension spring mounted therein.
Figure 7:
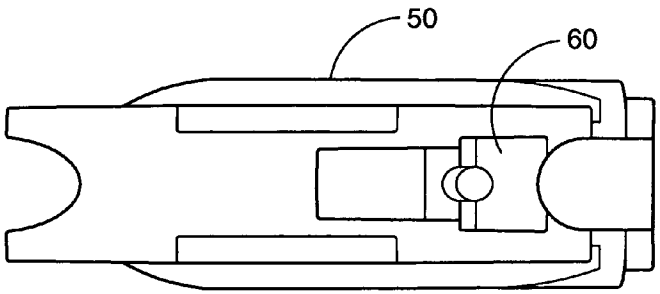
FIG. 7 depicts the bottom surface of retractable slide member.

FIG. 7 shows the bottom surface of retractable slide member 50. Also shown is the cam 60 on the bottom surface of slide member 50. FIG. 8 shows the rear end of replacement sleeve member 55 with the spring 58 mounted therein. As slide member 50 travels rearwardly when the gun is fired, cam 60 travels against cam member 53 on lever 51 causing extension spring 52 to be stretched downwardly in order to take up the recoil of the weapon being fired. The bottom detail of rib member 56 is also shown.

Figure 9:
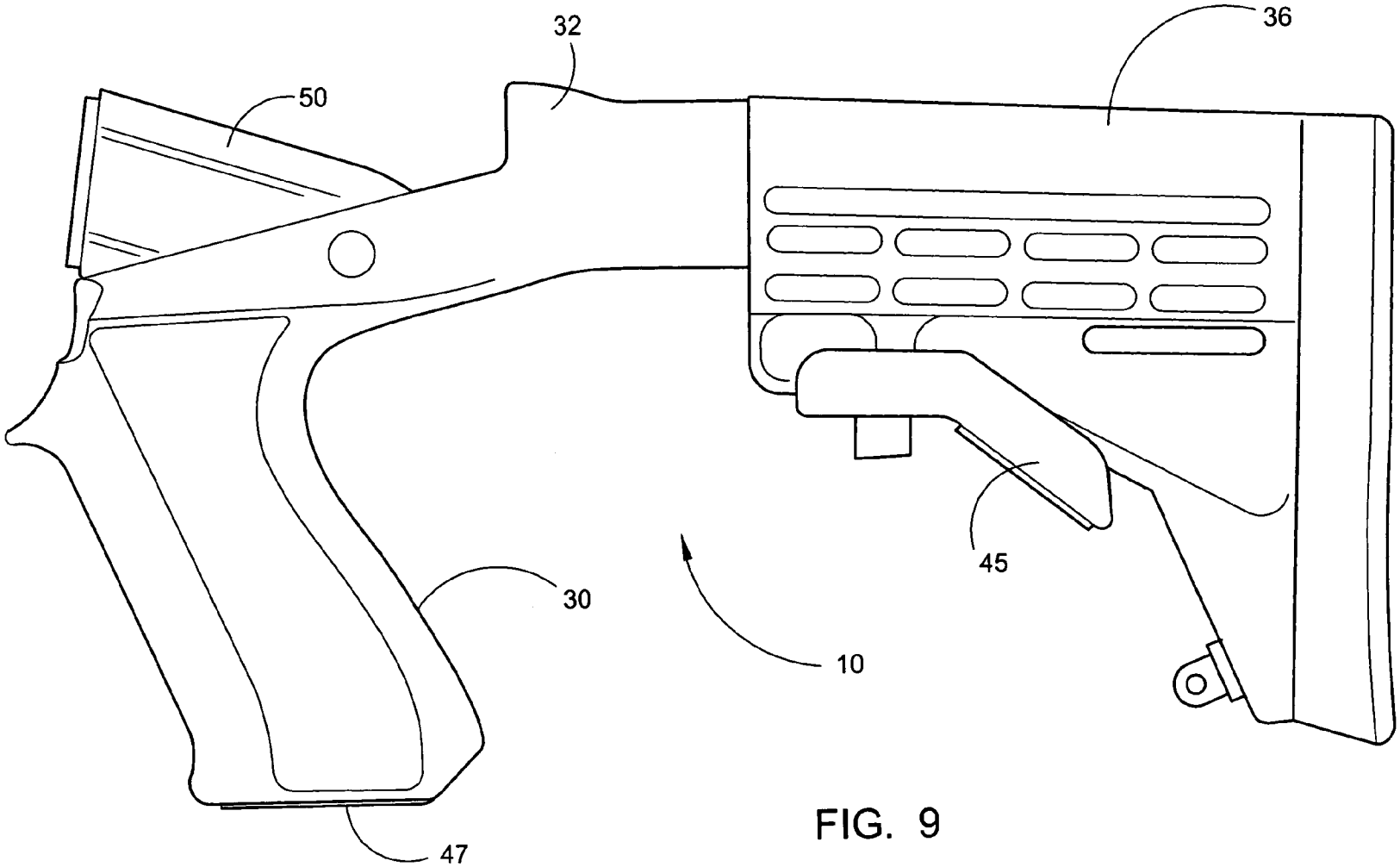
FIG. 9 depicts the adjustable length butt stock reinstalled on the tubular member after its recoil compression structure has been inserted therein.

FIG. 9 shows the Special Operations Stock 10 with the adjustable length butt stock 36 reinstalled on tubular member 32 after its recoil compression structure has been inserted therein. The assembled structure is now referred to as a Spec Ops stock assembly.

Figure 10:
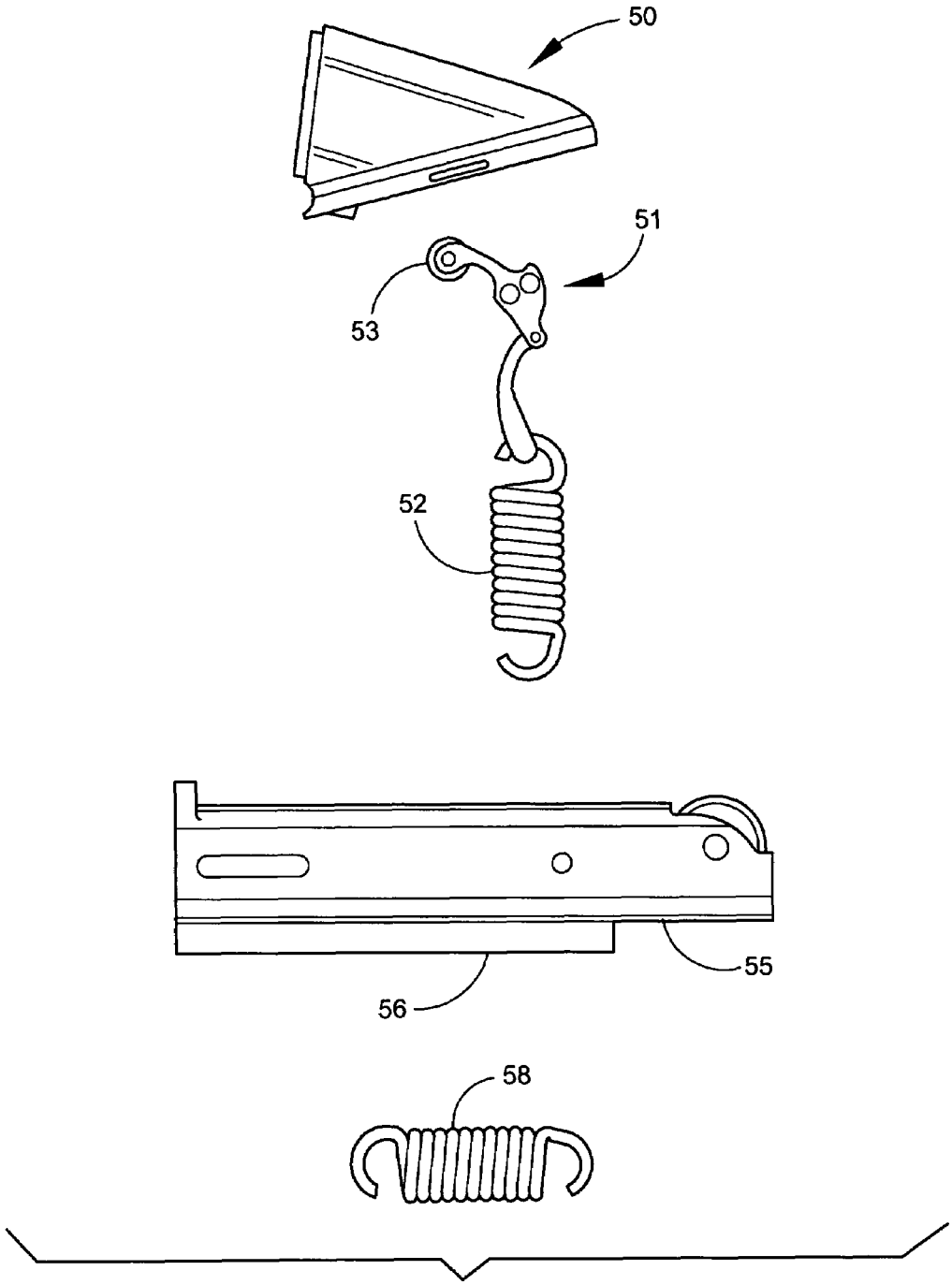
FIG. 10 depicts the recoil reduction mechanism for sliding member and the recoil reduction mechanism for the replacement sleeve.

FIG. 10 shows the individual components for the stock conversion for the Special Operations Stock 10; converting the Non-Recoil Suppressing Stock 8 to Special Operations Stock 10, consisting of the recoil reduction mechanism for sliding member 50 and the recoil reduction mechanism for replacement sleeve 55.

The upgrading process shown in the drawings and described in detail herein disclose arrangements of elements of particular construction and configuration for illustrating preferred embodiments of structure and method of operation of the present stock conversion method for the Special Operations Stock 10. It is to be understood, however, that elements of different construction and configuration and other arrangements thereof, other than those illustrated and described may be employed for providing an upgrading process in accordance with the spirit of this invention, and such changes, alterations and modifications as would occur to those skilled in the art are considered to be within the scope of this design as broadly defined in the appended claims.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

I claim:

1. A method of converting a firearm stock comprising the steps of:

(a) providing a non-recoil suppressing stock having a butt stock assembly, a tubular sleeve within a tubular member, a slide member and a hollow handgrip portion having a removable cover plate;

(b) disassembling said butt stock assembly from the end of said non-recoil suppressing stock;

(c) removing said tubular sleeve from within said tubular member, and removing said stationary slide member from said non-recoil suppressing stock;

(c) sliding off said removable cover plate from said hollow handgrip portion of said non-recoil suppressing stock;

(d) installing a lever assembly having a cam member and a lever assembly spring into the cavity of said hollow handgrip portion;

(e) installing a replacement sleeve having an internal replacement sleeve spring into said tubular member and affixing a replacement slide member onto said non-recoil suppressing stock; and (f) reassembling said butt stock assembly onto said non-recoil suppressing stock.

2. The method for converting a firearm stock according to claim 1, wherein said non-recoil suppressing stock is a special operations stock.

3. The method for converting a firearm stock according to claim 1, wherein said non-recoil suppressing stock is a special operations stock having a length adjustment mechanism.

* * * * *